US009385433B2

(12) United States Patent
Stoytchev

(10) Patent No.: US 9,385,433 B2
(45) Date of Patent: Jul. 5, 2016

(54) MULTIBAND HYBRID ANTENNA

(71) Applicant: GALTRONICS CORPORATION LTD., Tiberias, IL (US)

(72) Inventor: Marin Stoytchev, Chandler, AZ (US)

(73) Assignee: GALTRONICS CORPORATION, LTD., Tiberias (IL)

( * ) Notice: Subject to any disclaimer, the term of this patent is extended or adjusted under 35 U.S.C. 154(b) by 158 days.

(21) Appl. No.: 14/168,249

(22) Filed: Jan. 30, 2014

(65) Prior Publication Data

US 2014/0210680 A1 Jul. 31, 2014

Related U.S. Application Data

(60) Provisional application No. 61/758,335, filed on Jan. 30, 2013.

(51) Int. Cl.

| | |
|---|---|
| ***H01Q 9/16*** | (2006.01) |
| ***H01Q 9/26*** | (2006.01) |
| ***H01Q 5/342*** | (2015.01) |
| ***H01Q 5/364*** | (2015.01) |

(52) U.S. Cl.

CPC ..... *H01Q 9/26* (2013.01); *H01Q 5/342* (2015.01); *H01Q 5/364* (2015.01)

(58) Field of Classification Search

CPC ..... H01Q 9/26; H01Q 5/342; H01Q 5/364
USPC ..... 343/803, 812, 806
See application file for complete search history.

(56) References Cited

U.S. PATENT DOCUMENTS

| | | | | |
|---|---|---|---|---|
| 2,719,919 | A * | 10/1955 | Enslein | 343/803 |
| 3,605,103 | A * | 9/1971 | Simons | 343/812 |
| 6,094,177 | A | 7/2000 | Yamamoto | |
| 6,323,820 | B1 | 11/2001 | Haunberger | |
| 2003/0020656 | A1 | 1/2003 | Shor | |
| 2005/0107042 | A1 | 5/2005 | De Graauw | |
| 2008/0204343 | A1 | 8/2008 | Kildal | |
| 2010/0231462 | A1 | 9/2010 | Tran | |
| 2013/0002503 | A1 * | 1/2013 | Tan | 343/803 |

FOREIGN PATENT DOCUMENTS

WO 2014/118784 8/2014

OTHER PUBLICATIONS

U.S. Appl. No. 61/758,335, filed Jan. 30, 2013.
An International Search Report and Written Opinion both dated May 13, 2014, which issued during the prosecution of Applicant's PCT/IL2014/050111.

* cited by examiner

*Primary Examiner* — Jean B Jeanglaude
(74) *Attorney, Agent, or Firm* — Ingrassia Fisher & Lorenz, P.C.

(57) ABSTRACT

An antenna including a high band generating assembly having a first end and a second end, the high band generating assembly including a feed point and a bifurcated conductive element coupled to the feed point and having an angularly bent tip, the feed point defining the first end of the high band generating assembly, the angularly bent tip defining the second end of the high band generating assembly, at least one low band generating assembly, the at least one low band generating assembly including the high band generating assembly and at least one pair of dipole arms extending from the bifurcated conductive element, and a balun portion coupled to the feed point.

21 Claims, 9 Drawing Sheets

MULTIBAND HYBRID ANTENNA

REFERENCE TO RELATED APPLICATIONS

Reference is hereby made to U.S. Provisional Patent Application 61/758,335, entitled HYBRID BALANCED MULTIBAND ANTENNA, filed Jan. 30, 2013, the disclosure of which is hereby incorporated by reference and priority of which is hereby claimed pursuant to 37 CFR 1.78(a)(4) and (5)(i).

FIELD OF THE INVENTION

The present invention relates generally to antennas and more particularly to multiband antennas.

BACKGROUND OF THE INVENTION

Various types of multiband antennas are known in the art.

SUMMARY OF THE INVENTION

The present invention seeks to provide an improved highly compact hybrid multiband dipole antenna.

There is thus provided in accordance with a preferred embodiment of the present invention an antenna including a high band generating assembly having a first end and a second end, the high band generating assembly including a feed point and a bifurcated conductive element coupled to the feed point and having an angularly bent tip, the feed point defining the first end of the high band generating assembly, the angularly bent tip defining the second end of the high band generating assembly, at least one low band generating assembly, the at least one low band generating assembly including the high band generating assembly and at least one pair of dipole arms extending from the bifurcated conductive element, and a balun portion coupled to the feed point.

Preferably, the feed point is formed on the bifurcated conductive element.

In accordance with a preferred embodiment of the present invention the high band generating assembly has an electrical length generally equal to $\lambda/4$, where $\lambda$ is a wavelength of radiation in the high band.

In accordance with another preferred embodiment of the present invention the low band generating assembly has an electrical length generally equal to $\lambda/2$, where $\lambda$ is a wavelength of radiation in the low band.

Preferably, the angularly bent tip is bent at an angle of greater than 30° and preferably the angle is greater than 45°.

Preferably, the angularly bent tip includes a pair of angled discontinuities.

Preferably, the angled discontinuities are mutually symmetrical.

Alternatively, the angled discontinuities are mutually asymmetrical.

In accordance with a preferred embodiment of the present invention, the bifurcated conductive element includes a first strand and a second strand extending generally parallel to the first strand, the first and second strands being of generally equal widths, the high band generating assembly operating as a transmission line loaded dipole.

Alternatively, the bifurcated conductive element includes a first strand and a second strand, the first and second strands having different widths, the high band generating assembly operating as a folded monopole.

Preferably, the at least one pair of dipole arms includes a pair of mutually symmetrical dipole arms.

Alternatively, the at least one pair of dipole arms includes a pair of mutually assymetrical dipole arms.

In accordance with a further preferred embodiment of the present invention, the antenna also includes at least one additional pair of dipole arms extending from the bifurcated conductive element.

Preferably, the balun portion includes a slot formed by the bifurcated conductive element.

Preferably, the antenna also includes a coaxial cable having an inner conductor, the inner conductor of the coaxial cable being connected to the bifurcated conductive element, the feed point being formed thereby.

In accordance with a preferred embodiment of the present invention, the antenna has two-dimensional geometry.

Alternatively, the antenna has three-dimensional geometry.

Preferably, the antenna includes a stamped metal element.

Preferably, the antenna is formed on a surface of a non-conductive substrate.

Preferably, the non-conductive substrate includes a printed circuit board substrate.

In accordance with another preferred embodiment of the present invention, the antenna is free-standing.

Preferably, the antenna is adapted for mounting on a supporting surface, the supporting surface including at least one of a dedicated carrier and an enclosure of a wireless device.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
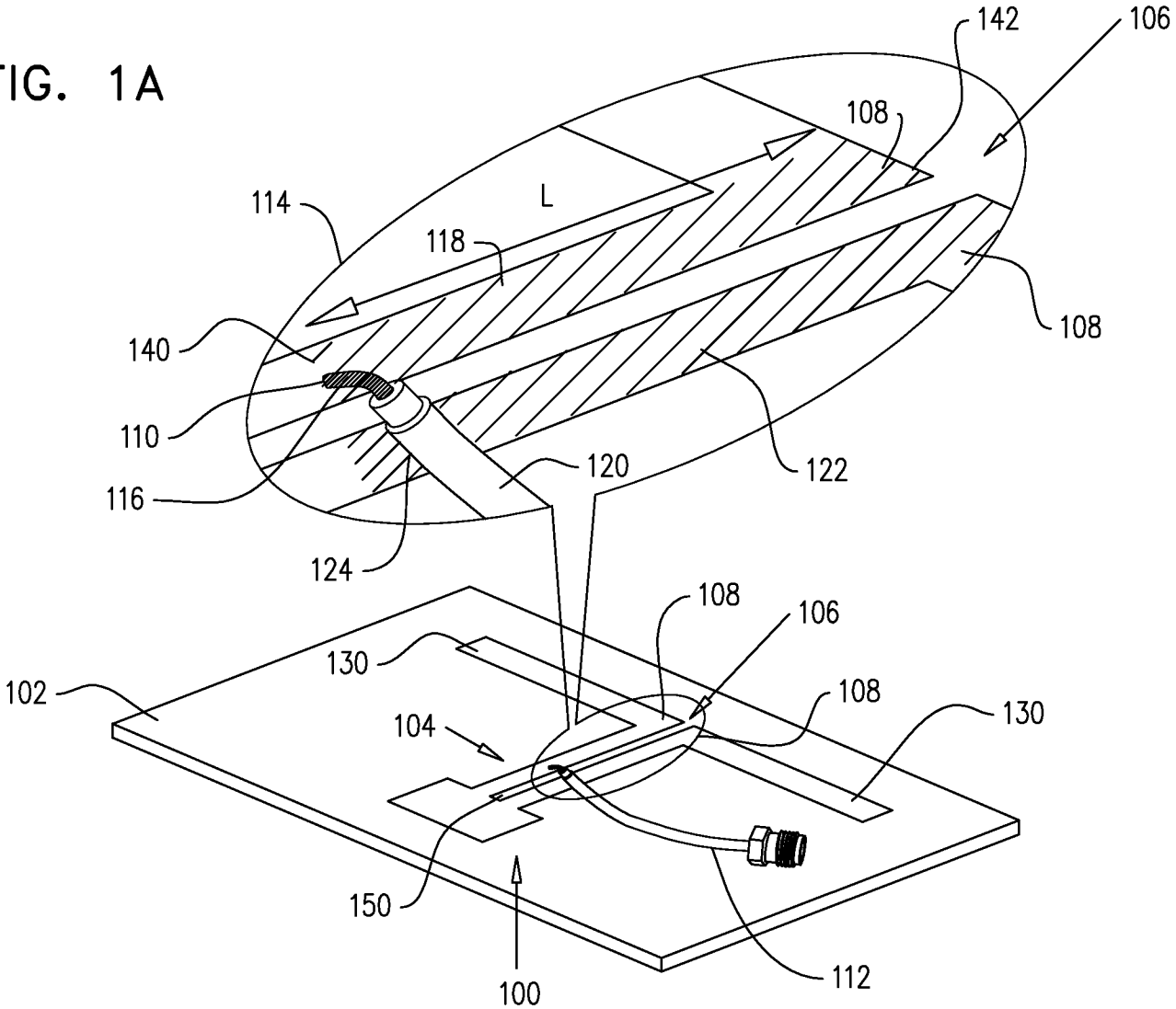
FIG. 1A is a simplified perspective view illustration of an antenna constructed and operative in accordance with a preferred embodiment of the present invention.
Figure 1B:
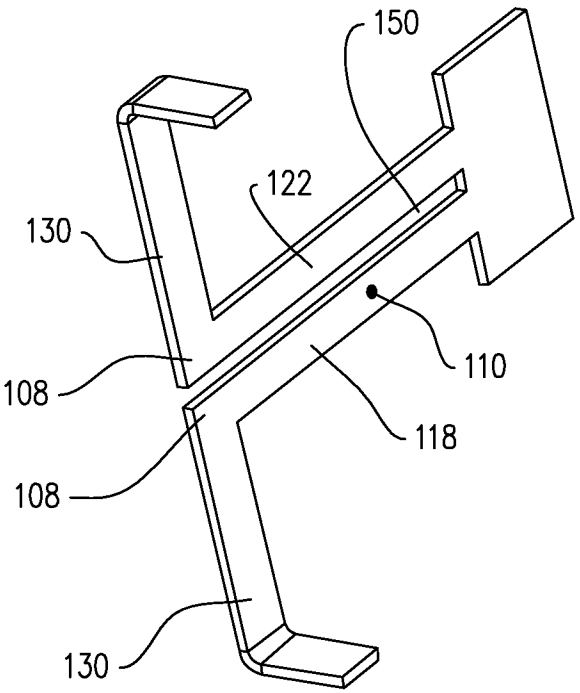
FIG. 1B is a simplified perspective view illustration of an antenna constructed and operative in accordance with another preferred embodiment of the present invention.

Reference is now made to FIG. 1A, which is a simplified perspective view illustration of an antenna constructed and operative in accordance with a preferred embodiment of the present invention; and to FIG. 1B, which is a simplified perspective view illustration of an antenna constructed and operative in accordance with another preferred embodiment of the present invention.

As seen in FIG. 1A, there is provided an antenna 100, which antenna 100 may be formed on an antenna substrate 102. Antenna substrate 102 may comprise a printed circuit board (PCB) substrate or may comprise alternative non-conductive substrates, as are well known in the art. Alternatively, substrate 102 may be obviated and antenna 100 formed as a free-standing element, as seen in FIG. 1B. Antenna 100 preferably includes a bifurcated conductive element 104 having an angularly bent tip 106. Here, by way of example, angularly bent tip 106 is embodied as a pair of symmetrical orthogonally angled discontinuities 108. It is appreciated, however, that angularly bent tip 106 may be embodied as a variety of symmetrical or non-symmetrical angularly bent portions, as will be described henceforth with reference to FIGS. 3A-7.

Bifurcated conductive element 104 is preferably coupled to and fed by way of a feed point 110. Feed point 110 is preferably disposed on bifurcated conductive element 104, spaced apart from angularly bent tip 106. Feed point 110 preferably receives a radio-frequency (RF) input signal by way of a transmission line, such as a coaxial cable 112. As seen most clearly at enlargement 114, an inner conductor 116 of coaxial cable 112 is preferably connected to a first strand 118 of bifurcated conductive element 104, thereby forming feed point 110. An outer conductive shield 120 of coaxial cable 112 is preferably connected to a second strand 122 of bifurcated conductive element, thereby forming a ground connection 124. It is understood, however, that the illustrated configuration of feed point 110 and ground connection 124 is exemplary only, and that feed point 110 and/or ground connection 124 may be formed by alternative respective feed and grounding arrangements as are well known in the art.

Antenna 100 further preferably includes at least one pair of dipole arms preferably extending from bifurcated conductive element 104, here embodied, by way of example, as a pair of dipole arms 130 preferably extending from angled discontinuities 108. Dipole arms 130 may be mutually symmetrical, as illustrated in FIG. 1A. Alternatively, dipole arms 130 may be mutually asymmetrical, as will be described henceforth with reference to FIGS. 3A and 3B.

It is particular feature of a preferred embodiment of the present invention that bifurcated conductive element 104, fed by feed point 110 and terminating in pair of dipole arms 130 preferably includes both a high band generating assembly and at least one low band generating assembly, which high and at least one low band generating assemblies preferably operate with minimal interdependence.

The high band generating assembly of antenna 100 preferably includes feed point 110 and bifurcated conductive element 104 coupled to feed point 110 and having angularly bent tip 106. Feed point 110 preferably defines a first end 140 of the high band generating assembly and angularly bent tip 106 preferably defines a second end 142 of the high band generating assembly. It is appreciated that first end 140 defined by feed point 110 is not necessarily demarked by a physically discontinuous portion of bifurcated conductive element 104. Rather, feed point 110 defines an effective end of the high band generating assembly due to the electrical operation thereof, as will be described in greater detail henceforth.

The high band generating assembly of antenna 100 is generally indicated by a hatched portion of antenna 100 in FIG. 1A. It is appreciated, however, that the high band generating assembly is integrally formed as a portion of bifurcated conductive element 104 in antenna 100 and its demarcation is for the sake of clarity of presentation and explanation only.

The at least one low band generating assembly of antenna 100, here embodied, by way of example as a low band generating assembly, preferably includes the high band generating assembly and at least a pair of dipole arms, here embodied, by way of example, as pair of dipole arms 130, preferably extending from bifurcated conductive element 104.

It is appreciated that antenna 100 thus constitutes a multiband antenna, including a high band generating assembly and a low band generating assembly, of which low band generating assembly the high band generating assembly preferably forms a part.

The above-described operation of a sub-portion of antenna 100 as a high band generating assembly is attributable to an electrical length L of first and second strands 118 and 122 of bifurcated conductive element 104 extending between feed point 110 and angularly bent tip 106. The inventor has found that when L is sufficiently large a significant accumulation of electrical charge occurs at angularly bent tip 106, such that the portion having electrical length L of bifurcated conductive element 104 acts as a high band resonant element in its own right.

The high band generating assembly of antenna 100 thus may be considered to act as a transmission line loaded dipole, formed by portion having length L of strand 118 connected to feed point 110 extending close to and in parallel with portion having length L of strand 122 having ground connection 124 thereon, strands 118 and 122 preferably being generally equal in width. In operation of antenna 100, electrical charges due to current flow from feed point 110 accumulate at angularly bent tip 106, thereby causing radiation.

The low band generating assembly of antenna 100 may be considered to act as a conventional dipole fed by feed point 110, wherein a total electrical length of the dipole comprises the electrical length L of the portion of bifurcated conductive element 104 extending between first and second ends 140 and 142, in combination with the electrical length of dipole arms 130.

Antenna 100 thus may be considered to be a hybrid antenna, including a transmission line loaded dipole operative in a high frequency band arranged in series with a conventional dipole operative in a low frequency band, wherein the transmission line loaded dipole forms a sub-portion of the conventional dipole.

It is appreciated that conventional dipole antenna structures are well known in the art. However, such conventional dipole antenna structures typically operate only in a single band of operation provided by the radiating properties of the dipole arms. It is a particular feature of a preferred embodiment of the present invention that antenna 100 operates as a multiband antenna, including a high band generating assembly attributable to the length L of bifurcated conductive element 104 between feed point 110 and angularly bent tip 106, in addition to the low band generating assembly provided by the radiative properties of dipole arms 130.

The formation of a high band generating assembly by a portion of antenna 100 is a highly advantageous feature thereof, since it allows the provision of a high band of operation in antenna 100 without the addition of any extra radiating portions. This is in contrast to conventional dipole antennas in which additional pairs of dipole arms must be added in order to provide a second band of operation. Such additional pairs of dipole arms increase the size of the antenna and tend to create mutual coupling, leading to degradation in antenna performance.

The electrical length L of the portion of bifurcated conductive element 104 between feed point 110 and angularly bent tip 106 is preferably equal or close to $\lambda/4$, where $\lambda$ is a wavelength corresponding to a desired high frequency band of operation of antenna 100. It is appreciated that the high band generating assembly of antenna 100 thus has a preferable electrical length of λ/4, where λ is a wavelength of radiation in the high frequency band of antenna 100.

The total electrical length of the arms of the low band dipole 130, which total electrical length preferably includes the electrical length of each one of the dipole arms from the feed point 110 to the end of the corresponding dipole arm, is preferably equal or close to λ/2, where λ is a wavelength corresponding to a desired low frequency band of operation of antenna 100. It is appreciated that the low band generating assembly of antenna 100 thus has a preferable electrical length of λ/2, where λ is a wavelength of radiation in the low frequency band of antenna 100.

In order for sufficient charge to accumulate at angularly bent tip 106 so as to ensure efficient radiation, it has been found that angularly bent tip 106 should preferably be bent at an angle of greater than 30° and should particularly preferably be bent at an angle of greater than 45°. At angles shallower than 45°, the impedance match of antenna 100 to the 50 Ohm input impedance of feed point 110 tends to worsen, thus degrading the performance of antenna 100.

A portion of bifurcated conductive element 104 coupled to and behind feed point 110 in a direction away from angularly bent tip 106, preferably forms a slot 150. Slot 150 preferably acts as a balun transformer, improving the impedance match of antenna 100 to feed point 110 and reducing undesirable currents that may be induced on outer conductive shield 118.

Antenna 100 may be embodied as a two-dimensional antenna, printed, plated or otherwise formed on PCB 102. It is appreciated, however, that antenna 100 may alternatively be formed as a two- or three-dimensional structure, without a supporting non-conductive substrate. By way of example, antenna 100 may be formed as a two- or three-dimensional sheet metal element, which sheet metal element may be attached to a dedicated plastic carrier or may be attached to a non-conductive portion of a housing of a wireless device, by any appropriate means as are well known in the art. It is further appreciated that antenna 100 may alternatively be embodied as a free-standing polymorphic three-dimensional structure, as illustrated in FIG. 1B. It is understood that feed point 110 is indicated by a single point 110 in FIG. 1B and the connection of coaxial cable 112 thereto omitted, for the sake of simplicity of presentation only.

Figure 2:
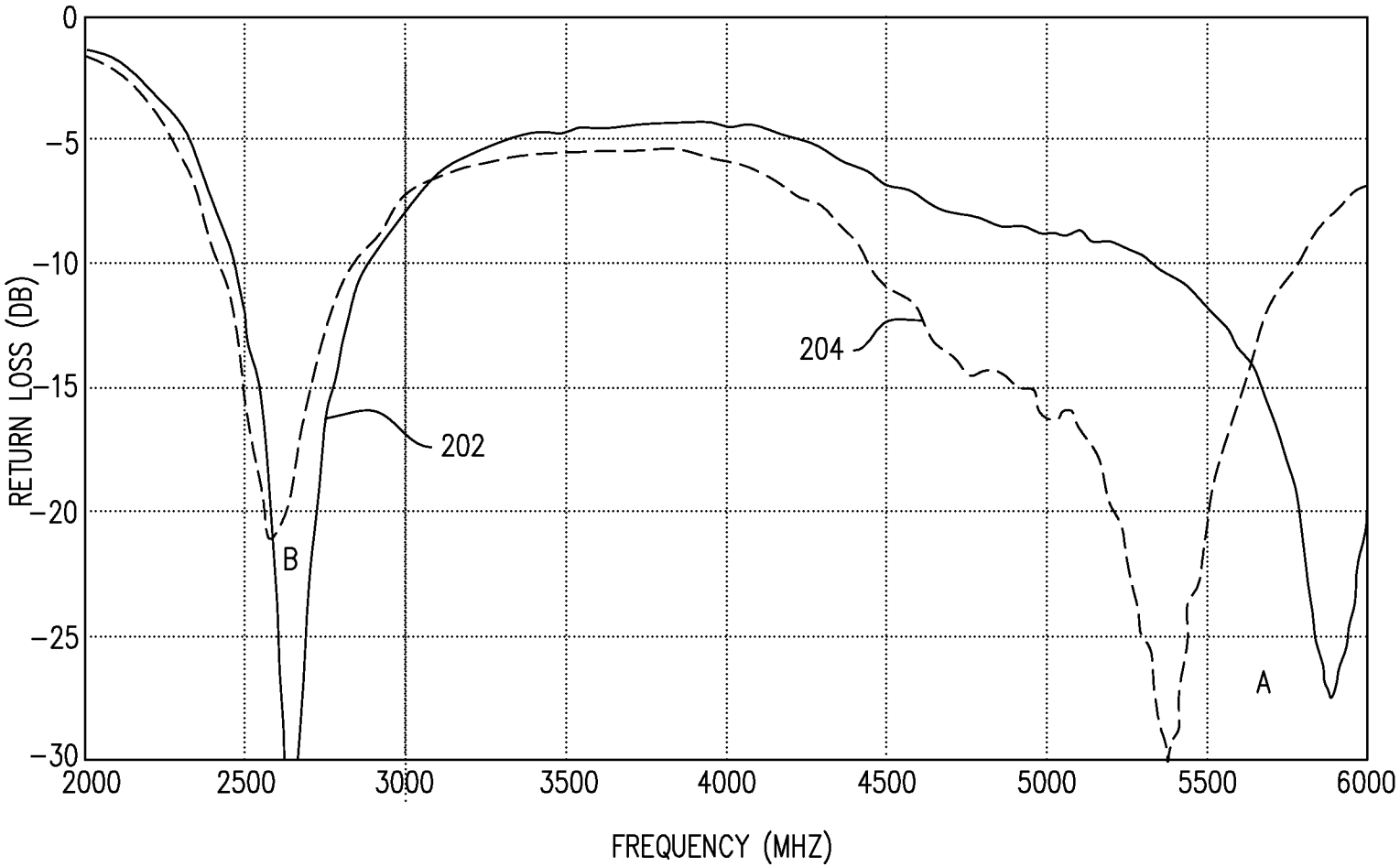
FIG. 2 is a graph illustrating a return loss of an antenna of the types illustrated in FIGS. 1A and 1B.

Reference is now made to FIG. 2, which is a graph illustrating a return loss of an antenna of the types illustrated in FIGS. 1A and 1B.

As seen in FIG. 2, a first line 202 illustrates the return loss of antenna 100 for a first location of feed point 110 and a second line 204 illustrates the return loss of antenna 100 for a second location of feed point 110, which second location may be offset by several millimeters from the first location of feed point 110 in a direction away from angularly bent tip 106. As is apparent from a comparison of the relative frequencies at which the respective minima of lines 202 and 204 occur, shifting the feed point in a direction away from angularly bent tip 106 creates a shift in both the low and high band resonances of antenna 100.

The high band resonance of antenna 100, situated in region A of the graph, is seen to undergo a greater frequency shift in response to the change in location of feed point 110 than the low band resonance, situated in region B of the graph. It is thus appreciated that the high and low frequency bands of antenna 100 may be tuned almost independently of each other by means of adjustment of the location of feed point 110, which adjustment preferably alters the separation between feed point 110 and bent angular tip 108 of antenna 100, thereby altering the physical and electrical lengths of both the low and high band generating assemblies of antenna 100.

As seen in FIG. 2, the high-frequency band may be centered at approximately 5800 MHz and the low-frequency band may be centered at approximately 2650 MHz for the first location of feed point 110. It is appreciated, however, that antenna 100 may be adapted for operation over a broad frequency range, including cellular communication frequencies, WiFi and WiMax, by way of example only.

Figure 3A:
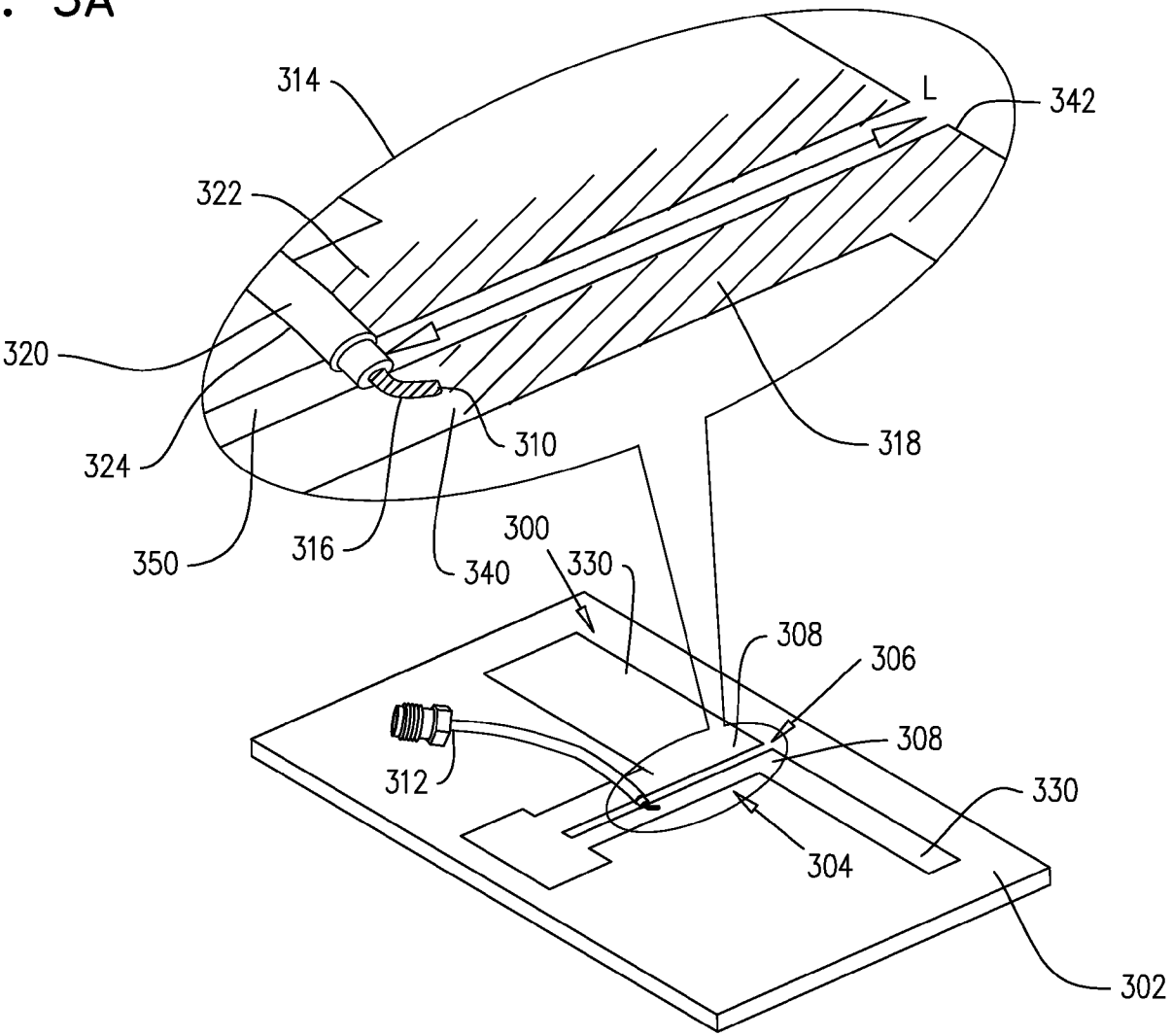
FIG. 3A is a simplified perspective view illustration of an antenna constructed and operative in accordance with a further preferred embodiment of the present invention.
Figure 3B:
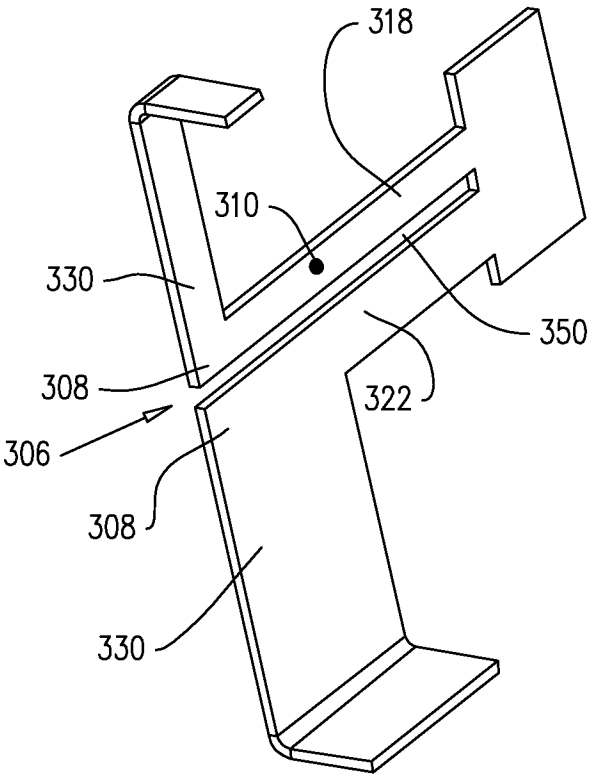
FIG. 3B is a simplified perspective view illustration of an antenna constructed and operative in accordance with yet a further preferred embodiment of the present invention.

Reference is now made to FIG. 3A, which is a simplified perspective view illustration of an antenna constructed and operative in accordance with a further preferred embodiment of the present invention; and to FIG. 3B, which is a simplified perspective view illustration of an antenna constructed and operative in accordance with yet a further preferred embodiment of the present invention.

As seen in FIG. 3A, there is provided an antenna 300, which antenna 300 may be formed on an antenna substrate 302. Antenna substrate 302 may comprise a PCB substrate or may comprise alternative non-conductive substrates, as are well known in the art. Alternatively, substrate 302 may be obviated and antenna 300 formed as a free-standing element, as seen in FIG. 3B. Antenna 300 preferably includes a bifurcated conductive element 304 having an angularly bent tip 306. Here, by way of example, angularly bent tip 306 is embodied as a pair of asymmetrical orthogonally angled discontinuities 308. It is appreciated, however, that angularly bent tip 306 may be embodied as a variety of symmetrical or non-symmetrical angularly bent portions, as will be described henceforth with reference to FIGS. 4-7.

Bifurcated conductive element 304 is preferably coupled to and fed by way of a feed point 310. Feed point 310 is preferably disposed on bifurcated conductive element 304, spaced apart from angularly bent tip 306. Feed point 310 preferably receives an RF input signal by way of a transmission line, such as a coaxial cable 312. As seen most clearly at enlargement 314, an inner conductor 316 of coaxial cable 312 is preferably connected to a first strand 318 of bifurcated conductive element 304, thereby forming feed point 310. An outer conductive shield 320 of coaxial cable 312 is preferably connected to a second strand 322 of bifurcated conductive element, thereby forming a ground connection 324. It is understood, however, that the illustrated configuration of feed point 310 and ground connection 324 is exemplary only, and that feed point 310 and/or ground connection 324 may be formed by alternative respective feed and grounding arrangements as are well known in the art.

Antenna 300 further preferably includes at least one pair of dipole arms extending from bifurcated conductive element 304, here embodied, by way of example, as a pair of dipole arms 330 preferably extending from angled discontinuities 308. Dipole arms 330 are preferably mutually asymmetrical, preferably having different lengths and/or widths to each other.

It is particular feature of a preferred embodiment of the present invention that bifurcated conductive element 304, fed by feed point 310 and terminating in pair of dipole arms 330 preferably includes both a high band generating assembly and at least one low band generating assembly, which high and at least one low band generating assemblies preferably operate with minimal interdependence.

The high band generating assembly of antenna 300 preferably includes feed point 310 and bifurcated conductive element 304 coupled to feed point 310 and having angularly bent tip 306. Feed point 310 preferably defines a first end 340 of the high band generating assembly and angularly bent tip 306 preferably defines a second end 342 of the high band generating assembly. It is appreciated that first end 340 defined by feed point 310 is not necessarily demarked by a physically discontinuous portion of bifurcated conductive element 304.

Rather, feed point 310 defines an effective end of the high band generating assembly due to the electrical operation thereof, as will be described in greater detail henceforth.

The high band generating assembly of antenna 300 is generally indicated by a hatched portion of antenna 300 in FIG. 3A. It is appreciated, however, that the high band generating assembly is integrally formed as a portion of bifurcated conductive element 304 in antenna 300 and its demarcation is for the sake of clarity of presentation and explanation only.

The at least one low band generating assembly of antenna 300, here embodied, by way of example as a low band generating assembly, preferably includes the high band generating assembly and at least a pair of dipole arms, here embodied, by way of example as pair of dipole arms 330, preferably extending from bifurcated conductive element 304.

It is appreciated that antenna 300 thus constitutes a multiband antenna, including a high band generating assembly and a low band generating assembly, of which low band generating assembly the high band generating assembly preferably forms a part.

The above-described operation of a sub-portion of antenna 300 as a high band generating assembly is attributable to an electrical length L of first and second strands 318 and 322 of bifurcated conductive element 304 extending between feed point 310 and angularly bent tip 306. The inventor has found that when L is sufficiently large a significant accumulation of electrical charge occurs at angularly bent tip 306, such that the portion having electrical length L of bifurcated conductive element 304 acts as a high band resonant element in its own right.

The high band generating assembly of antenna 300 thus may be considered to act as folded monopole, formed by relatively narrow portion having length L of first strand 318 connected to feed point 310, extending close to and in parallel with a relatively wide portion of second strand 322. In operation of antenna 300, electrical charges due to current flow from feed point 310 accumulate at angularly bent tip 306, thereby causing radiation.

The low band generating assembly of antenna 300 may be considered to act as a conventional dipole fed by feed point 310, wherein a total electrical length of the dipole comprises the electrical length L of the portion of bifurcated conductive element 304 extending between first and second ends 340 and 342, in combination with the electrical length of dipole arms 330.

Antenna 300 thus may be considered to be a hybrid antenna, including a folded monopole operative in a high frequency band arranged in series with a conventional dipole operative in a low frequency band, wherein the folded monopole preferably forms a sub-portion of the conventional dipole.

It is appreciated that conventional dipole antenna structures are well known in the art. However, such conventional dipole antenna structures typically operate only in a single band of operation provided by the radiating properties of the dipole arms. It is a particular feature of a preferred embodiment of the present invention that antenna 300 operates as a multiband antenna, including a high band generating assembly attributable to the length of bifurcated conductive element 304 between feed point 310 and angularly bent tip 306, in addition to the low band generating assembly provided by the radiative properties of dipole arms 330.

The formation of a high band generating assembly by a portion of antenna 300 is a highly advantageous feature thereof, since it allows the provision of a high band of operation in antenna 300 without the addition of any extra radiating portions. This is in contrast to conventional dipole antennas in which additional pairs of dipole arms must be added in order to provide a second band of operation. Such additional pairs of dipole arms increase the size of the antenna and tend to create mutual coupling, leading to degradation in antenna performance.

The electrical length L of the portion of bifurcated conductive element 304 between feed point 310 and angularly bent tip 306 is preferably equal or close to $\lambda/4$, where $\lambda$ is a wavelength corresponding to a desired high frequency band of operation of antenna 300. It is appreciated that the high band generating assembly of antenna 300 thus has a preferable electrical length of $\lambda/4$, where $\lambda$ is a wavelength of radiation in the high frequency band of antenna 300.

The total electrical length of the arms of the low band dipole 330, which total electrical length preferably includes the electrical length of each one of the dipole arms from the feed point 310 to the end of the corresponding dipole arm, is preferably equal or close to $\lambda/2$, where $\lambda$ is a wavelength corresponding to a desired low frequency band of operation of antenna 300. It is appreciated that the low band generating assembly of antenna 300 thus has a preferable electrical length of $\lambda/2$, where $\lambda$ is a wavelength of radiation in the low frequency band of antenna 300.

In order for sufficient charge to accumulate at angularly bent tip 306 so as to ensure efficient radiation, it has been found that angularly bent tip 306 should preferably be bent at an angle of greater than 30° and should particularly preferably be bent at an angle of greater than 45°. At angles shallower than 45°, the impedance match of antenna 300 to the 50 Ohm input impedance of feed point 310 tends to worsen, thus degrading the performance of antenna 300.

Figure 5:
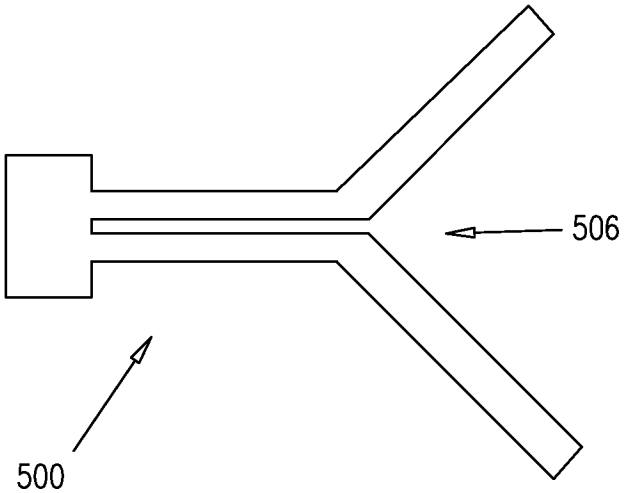
FIGS. 4, 5, 6 and 7 are simplified respective top view illustrations of antennas constructed and operative in accordance with yet other preferred respective alternative embodiments of the present invention.
Figure 4:
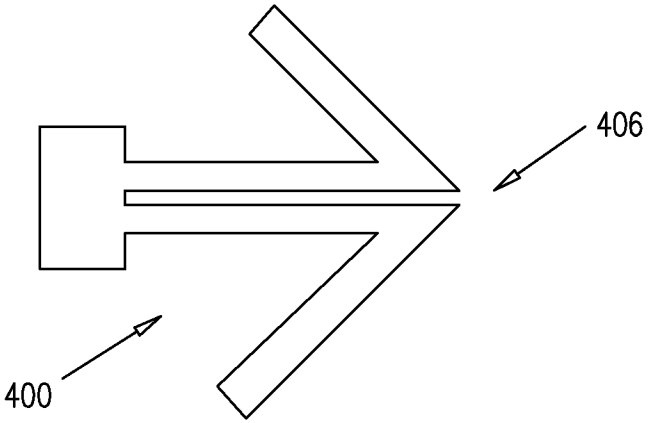
Figure 7:
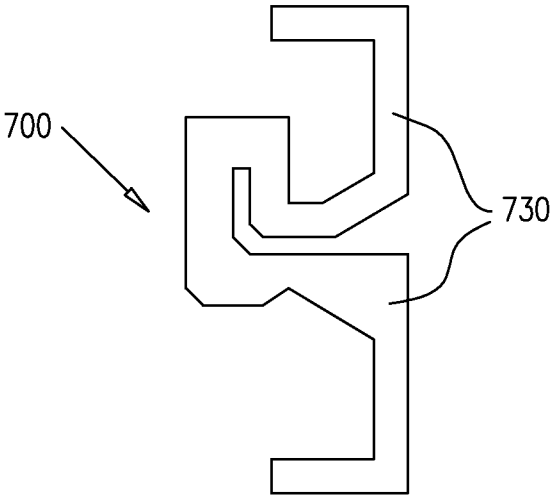
Figure 6:
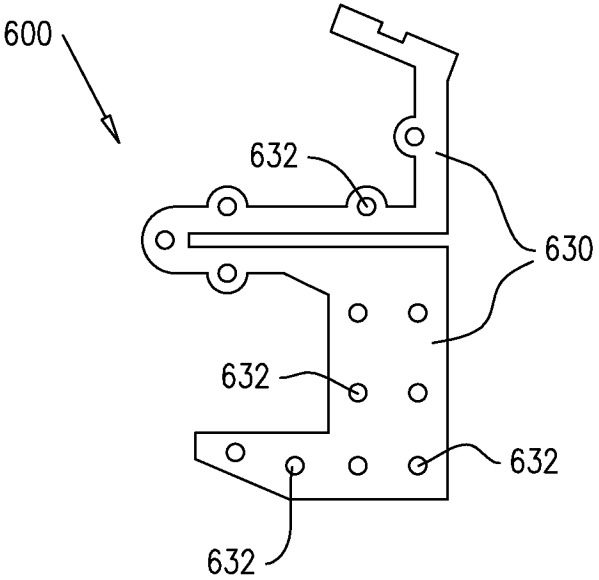

Alternative possible configurations of angularly bent tips of antennas constructed and operative in accordance with preferred embodiments of the present invention are respectively illustrated in FIGS. 4 and 5. As seen in FIGS. 4 and 5, angularly bent tips 406 and 506 may be respectively bent at angles of ±45°.

Dipole arms 330 may be linear, as seen in FIG. 3A. Alternatively, dipole arms 330 may be non-linear, as seen in the case of angled dipole arms 630 in antenna 600 of FIG. 6. Antenna 600 is shown to include a multiplicity of stake holes for attaching antenna 600 to a supporting surface. Furthermore, dipole arms 330 may have a meandering configuration, as seen in the case of dipole arms 730 in antenna 700 of FIG. 7.

A portion of bifurcated conductive element 304 coupled to and behind feed point 310 in a direction away from angularly bent tip 306, preferably forms a slot 350. Slot 350 preferably acts as a balun transformer, improving the impedance match of antenna 300 to feed point 310 and reducing undesirable currents that may be induced on outer conductive shield 318.

Antenna 300 may be embodied as a two-dimensional antenna, printed, plated or otherwise formed on PCB 302. It is appreciated, however, that antenna 300 may alternatively be formed as a two- or three-dimensional structure, without a supporting non-conductive substrate. By way of example, antenna 300 may be formed as a two- or three-dimensional sheet metal element, which sheet metal element may be attached to a dedicated plastic carrier or may be attached to a non-conductive portion of a housing of a wireless device, by any appropriate means as are well known in the art. It is further appreciated that antenna 300 may alternatively be embodied as a free-standing polymorphic three-dimensional structure, as illustrated in FIG. 3B. It is understood that feed point 310 is indicated by a single point 310 in FIG. 3B and the connection of coaxial cable 312 thereto omitted, for the sake of simplicity of presentation only.

Figure 8A:
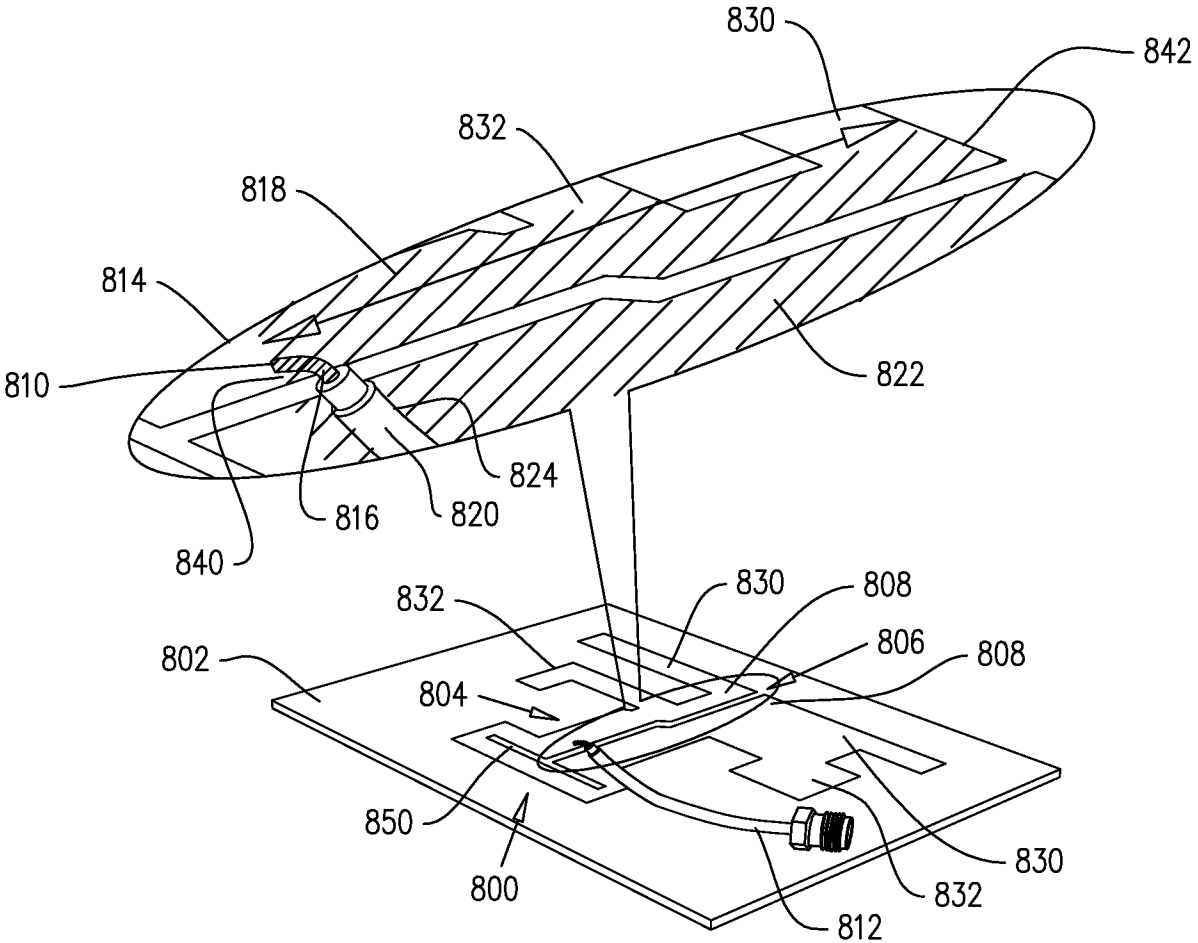
FIG. 8A is a simplified perspective view illustration of an antenna constructed and operative in accordance with still another preferred embodiment of the present invention.
Figure 8B:
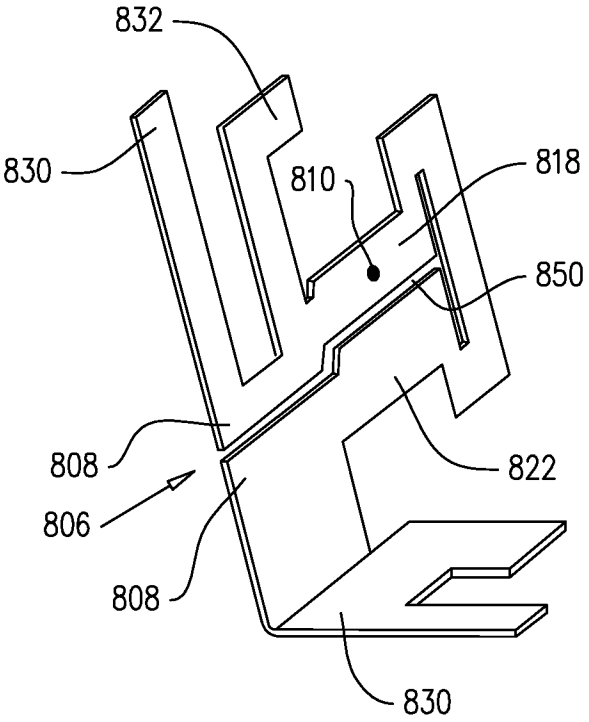
FIG. 8B is a simplified perspective view illustration of an antenna constructed and operative in accordance with a still further preferred embodiment of the present invention.

Reference is now made to FIG. 8A, which is a simplified perspective view illustration of an antenna constructed and operative in accordance with still another preferred embodiment of the present invention; and to FIG. 8B, which is a simplified perspective view illustration of an antenna constructed and operative in accordance with a still further preferred embodiment of the present invention.

As seen in FIG. 8A, there is provided an antenna 800, which antenna 800 may be formed on an antenna substrate 802. Antenna substrate 802 may comprise a PCB substrate or may comprise alternative non-conductive substrates, as are well known in the art. Alternatively, substrate 802 may be obviated and antenna 800 formed as a free-standing element, as seen in FIG. 8B. Antenna 800 preferably includes a bifurcated conductive element 804 having an angularly bent tip 806. Here, by way of example, angularly bent tip 806 is embodied as a pair of asymmetrical orthogonally angled discontinuities 808. It is appreciated, however, that angularly bent tip 806 may be embodied as a variety of symmetrical or non-symmetrical angularly bent portions.

Bifurcated conductive element 804 is preferably coupled to and fed by way of a feed point 810. Feed point 810 is preferably disposed on bifurcated conductive element 804, spaced apart from angularly bent tip 806. Feed point 810 preferably receives a RF input signal by way of a transmission line, such as a coaxial cable 812. As seen most clearly at enlargement 814, an inner conductor 816 of coaxial cable 812 is preferably connected to a first strand 818 of bifurcated conductive element 804, thereby forming feed point 810. An outer conductive shield 820 of coaxial cable 812 is preferably connected to a second strand 822 of bifurcated conductive element, thereby forming a ground connection 824. It is understood, however, that the illustrated configuration of feed point 810 and ground connection 824 is exemplary only, and that feed point 810 and/or ground connection 824 may be formed by alternative respective feed and grounding arrangements as are well known in the art.

Antenna 800 further preferably includes at least one pair of dipole arms extending from bifurcated conductive element 804, here embodied, by way of example, as a first pair of dipole arms 830 preferably extending from angled discontinuities 808 and a second pair of dipole arms 832 preferably extending from bifurcated conductive element 804. In the embodiment of antenna 800 shown in FIGS. 8A and 8B, dipole arms 830 and 832 are seen to be mutually asymmetrical, preferably having different lengths and/or widths to each other. It is appreciated, however, that one or both of dipole arms 830 and 832 may alternatively be mutually symmetrical.

It is particular feature of a preferred embodiment of the present invention that bifurcated conductive element 804, fed by feed point 810 and having first and second pairs of dipole arms 830 and 832 extending therefrom preferably includes both a high band generating assembly and a first and a second low band generating assembly, which high and first and second low band generating assemblies preferably operate with minimal interdependence.

The high band generating assembly of antenna 800 preferably includes feed point 810 and bifurcated conductive element 804 coupled to feed point 810 and having angularly bent tip 806. Feed point 810 preferably defines a first end 840 of the high band generating assembly and angularly bent tip 806 preferably defines a second end 842 of the high band generating assembly. It is appreciated that first end 840 defined by feed point 810 is not necessarily demarked by a physically discontinuous portion of bifurcated conductive element 804. Rather, feed point 810 defines an effective end of the high band generating assembly due to the electrical operation thereof, as will be described in greater detail henceforth.

The high band generating assembly of antenna 800 is generally indicated by a hatched portion of antenna 800 in FIG. 8A. It is appreciated, however, that the high band generating assembly is integrally formed as a portion of bifurcated conductive element 804 in antenna 800 and its demarcation is for the sake of clarity of presentation and explanation only.

The at least one low band generating assembly of antenna 800, here embodied, by way of example as a first and a second low band generating assembly, preferably includes the high band generating assembly and at least a pair of dipole arms, here embodied, by way of example as first and second pairs of dipole arms 830 and 832, preferably extending from bifurcated conductive element 804. A first low frequency band is preferably provided by first pair of dipole arms 830 and a second low frequency band is preferably provided by second pair of dipole arms 832.

It is appreciated that antenna 800 thus constitutes a triple band antenna, including a high band generating assembly and first and second low band generating assemblies. It is understood that the operation of antenna 800 may be readily modified by way of the addition of greater numbers of dipole arms, whereby further low-frequency bands of operation may be generated, provided that the various dipole arms are sufficiently mutually decoupled.

The above-described operation of a sub-portion of antenna 800 as a high band generating assembly is attributable to an electrical length L of first and second strands 818 and 822 of bifurcated conductive element 804 extending between feed point 810 and angularly bent tip 806. The inventor has found that when L is sufficiently large a significant accumulation of electrical charge occurs at angularly bent tip 806, such that the portion having electrical length L of bifurcated conductive element 804 acts as a high band resonant element in its own right.

The high band generating assembly of antenna 800 may be considered to act as folded monopole, formed by relatively narrow portion having length L of first strand 818 connected to feed point 810 extending close to and generally in parallel with a relatively wide portion of second strand 822. In operation of antenna 800, electrical charges due to current flow from feed point 810 accumulate at angularly bent tip 806, thereby causing radiation.

The first and second low band generating assemblies of antenna 800 may be considered to act as conventional dipoles, fed by feed point 810. Antenna 800 thus may be considered to be a hybrid antenna, including a folded monopole operative in a high frequency band arranged in series with conventional dipoles operative in first and second low frequency bands, wherein a part of the folded monopole preferably forms a sub-portion of the conventional dipoles.

It is appreciated that conventional dipole antenna structures are well known in the art. However, such conventional dipole antenna structures typically operate only in a single band of operation provided by the radiating properties of the dipole arms. It is a particular feature of a preferred embodiment of the present invention that antenna 800 preferably operates as a multiband antenna, including a high band generating assembly attributable to the length of bifurcated conductive element 804 between feed point 810 and angularly bent tip 806, in addition to the low band generating assemblies provided by the radiative properties of dipole arms 830 and 832.

The formation of a high band generating assembly by a portion of antenna 800 is a highly advantageous feature thereof, since it allows the provision of a high band of operation in antenna 800 without the addition of any extra radiating portions. This is in contrast to conventional dipole antennas in which additional pairs of dipole arms must be added in order to provide a high band of operation. Such additional pairs of dipole arms increase the size of the antenna and tend to couple to each other, leading to degradation in antenna performance.

The electrical length L of the portion of bifurcated conductive element 804 between feed point 810 and angularly bent tip 806 is preferably equal or close to $\lambda/4$, where $\lambda$ is a wavelength corresponding to a desired high frequency band of operation of antenna 800. It is appreciated that the high band generating assembly of antenna 800 thus has a preferable electrical length of $\lambda/4$, where $\lambda$ is a wavelength of radiation in the high frequency band of antenna 800.

The total electrical length of the arms of the first low band dipole 830, which total electrical length includes the electrical length of each one of the dipole arms 830 from the feed point 810 to the ends of the corresponding dipole arms, is preferably equal or close to $\lambda/2$, where $\lambda$ is a wavelength corresponding to a desired low frequency band of operation of antenna 800 associated with dipole arms 830.

The total electrical length of the arms of the low band dipole 832, which total electrical length includes the electrical length of each one of the dipole arms 832 from the feed point 810 to the ends of the corresponding dipole arms, is preferably equal or close to $\lambda/4$, where $\lambda$ is a wavelength corresponding to a desired low frequency band of operation of antenna 800 associated with dipole arms 832.

In order for sufficient charge to accumulate at angularly bent tip 806 so as to ensure efficient radiation, it has been found that angularly bent tip 806 should preferably be bent at an angle of greater than 30° and should particularly preferably be bent at an angle of greater than 45°. At angles shallower than 45°, the impedance match of antenna 800 to the 50 Ohm input impedance of feed point 810 tends to worsen, thus degrading the performance of antenna 800.

A portion of bifurcated conductive element 804 coupled to and behind feed point 810 in a direction away from angularly bent tip 806 preferably forms a slot 850. Slot 850 preferably acts as a balun transformer, improving the impedance match of antenna 800 to feed point 810 and reducing undesirable currents that may be induced on outer conductive shield 318.

Antenna 800 may be embodied as a two-dimensional antenna, printed, plated or otherwise formed on PCB 802. It is appreciated, however, that antenna 800 may alternatively be formed as a two- or three-dimensional structure, without a supporting non-conductive substrate. By way of example, antenna 800 may be embodied as a two- or three-dimensional sheet metal element, which sheet metal element may be attached to a dedicated plastic carrier or may be attached to a non-conductive portion of a housing of a wireless device, by any appropriate means as are well known in the art. It is further appreciated that antenna 800 may alternatively be embodied as a free-standing polymorphic three-dimensional structure, as illustrated in FIG. 8B. It is understood that feed point 810 is indicated by a single point 810 in FIG. 8B and the connection of coaxial cable 812 thereto omitted, for the sake of simplicity of presentation only.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. An antenna comprising:

a high band generating assembly having a first end and a second end, said high band generating assembly comprising;

a feed point; and a bifurcated conductive element coupled to said feed point and having an angularly bent tip, said feed point defining said first end of said high band generating assembly, said angularly bent tip defining said second end of said high band generating assembly, at least one low band generating assembly, said at least one low band generating assembly comprising said high band generating assembly and at least one pair of dipole arms extending from said bifurcated conductive element, and a balun portion coupled to said feed point.

2. An antenna according to claim 1 wherein said feed point is formed on said bifurcated conductive element.

3. An antenna according to claim 1, wherein said high band generating assembly has an electrical length generally equal to $\lambda/4$, where $\lambda$ is a wavelength of radiation in said high band.

4. An antenna according to claim 1, wherein said low band generating assembly has an electrical length generally equal to $\lambda/2$, where $\lambda$ is a wavelength of radiation in said low band.

5. An antenna according to claim 1, wherein said angularly bent tip is bent at an angle of greater than 30°.

6. An antenna according to claim 5, wherein said angle is greater than 45°.

7. An antenna according to claim 1, wherein said angularly bent tip comprises a pair of angled discontinuities.

8. An antenna according to claim 7, wherein said angled discontinuities are mutually symmetrical.

9. An antenna according to claim 7, wherein said angled discontinuities are mutually asymmetrical.

10. An antenna according to claim 1, wherein said bifurcated conductive element comprises a first strand and a second strand extending generally parallel to said first strand, said first and second strands being of generally equal widths, said high band generating assembly operating as a transmission line loaded dipole.

11. An antenna according to claim 1, wherein said bifurcated conductive element comprises a first strand and a second strand, said first and second strands having different widths, said high band generating assembly operating as a folded monopole.

12. An antenna according to claim 1, wherein said at least one pair of dipole arms comprises a pair of mutually symmetrical dipole arms.

13. An antenna according to claim 1, wherein said at least one pair of dipole arms comprises a pair of mutually asymmetrical dipole arms.

14. An antenna according to claim 1, wherein said at least one pair of dipole arms comprises two pairs of dipole arms.

15. An antenna according to claim 1, wherein said antenna has two-dimensional geometry.

16. An antenna according to claim 1, wherein said antenna has three-dimensional geometry.

17. An antenna according to claim 15, wherein said antenna comprises a stamped metal element.

18. An antenna according to claim 15, wherein said antenna is formed on a surface of a non-conductive substrate.

19. An antenna according to claim 18, wherein said non-conductive substrate comprises a printed circuit board substrate.

20. An antenna according to claim 16, wherein said antenna is adapted for mounting on a supporting surface, said supporting surface comprising at least one of a dedicated carrier and an enclosure of a wireless device.

21. An antenna, comprising:

a first conductive element arranged in a first direction;

a second conductive element arranged substantially parallel to the first direction;

a first dipole coupled to a first end of the first conductive element;

a second dipole coupled to a first end of the second conductive element; and a feed point coupled to the first conductive element, wherein the first and second dipoles are configured to radiate within a first frequency band upon the feed point receiving a radio frequency signal based upon a length of the first and second dipoles and the first conductive element is configured to radiate within a second frequency band upon the feed point receiving a radio frequency signal based upon a distance between the feed point and the first end of the first conductive element.

* * * * *